US012768123B2

(12) United States Patent
Botelho Charnaux Serta et al.

(10) Patent No.: US 12,768,123 B2
(45) Date of Patent: Oct. 20, 2026

(54) SUBSEA FOUNDATIONS

(71) Applicant: Subsea 7 do Brasil Servicos Ltda, Niteroi (BR)

(72) Inventors: Bernardo Botelho Charnaux Serta, Rio de Janeiro (BR); Joao Luiz Vaz Coelho, Copacabana (BR); Paulo Anderson Nascimento Silva, Sao Goncalo (BR)

(73) Assignee: SUBSEA 7 DO BRASIL SERVICOS LTDA, Niteroi (BR)

( * ) Notice: Subject to any disclaimer, the term of this patent is extended or adjusted under 35 U.S.C. 154(b) by 421 days.

(21) Appl. No.: 18/274,987

(22) PCT Filed: Feb. 16, 2022

(86) PCT No.: PCT/BR2022/050049

§ 371 (c)(1),
(2) Date: Jul. 28, 2023

(87) PCT Pub. No.: WO2022/174318

PCT Pub. Date: Aug. 25, 2022

(65) Prior Publication Data

US 2025/0283290 A1 Sep. 11, 2025

(30) Foreign Application Priority Data

Feb. 17, 2021 (GB) ..... 2102252

(51) Int. Cl.
*E02D 27/52* (2006.01)
*E02D 5/54* (2006.01)

(52) U.S. Cl.
CPC ..... *E02D 27/525* (2013.01); *E02D 5/54* (2013.01)

(58) Field of Classification Search
CPC ..... E02D 27/525; E02D 5/54
See application file for complete search history.

(56) References Cited

U.S. PATENT DOCUMENTS 6,685,396 B1 * 2/2004 Bergeron ..... F16G 11/00 405/226
6,851,895 B2 2/2005 Jarry et al.
(Continued)

FOREIGN PATENT DOCUMENTS

KR 2014-0078951 6/2014
WO WO 02/062653 8/2002
(Continued)

*Primary Examiner* — Kyle Armstrong
(74) *Attorney, Agent, or Firm* — MATTINGLY & MALUR, PC

(57) ABSTRACT

A subsea foundation comprises an upright pile, a support table on top of the pile, and a capture rod fixed to the pile and extending above a level of the support table. A lower end of the capture rod is fixed to a side wall of the pile, and the capture rod is inclined away from a central longitudinal axis of the pile in an upward direction. A line such as a pipeline or a mooring line is then connected to the subsea foundation by suspending a connecting structure from the line, capturing the connecting structure on the capture rod and pivoting the connecting structure about the capture rod before landing the connecting structure on the support table. The connecting structure can be pivoted about the capture rod around horizontal and/or vertical axes and can be slid down the capture rod before landing on the support table.

41 Claims, 9 Drawing Sheets

(56) References Cited

U.S. PATENT DOCUMENTS

| | | | | |
|---|---|---|---|---|
| 7,360,968 | B2 | 4/2008 | van Zandwijk | |
| 7,600,569 | B2 | 10/2009 | Routeau et al. | |
| 7,794,177 | B2 | 9/2010 | DeLack | |
| 8,038,368 | B2 | 10/2011 | Luppi et al. | |
| 8,425,154 | B1 | 4/2013 | Lugo | |
| 8,882,392 | B1 | 11/2014 | Cruz et al. | |
| 9,140,384 | B2 | 9/2015 | Hammer et al. | |
| 10,894,581 | B2 | 1/2021 | Wong et al. | |
| 2007/0017429 | A1* | 1/2007 | Riggs | B63B 21/50 114/293 |
| 2011/0002742 | A1* | 1/2011 | Maconocie | E21B 7/20 405/227 |
| 2014/0352972 | A1 | 12/2014 | Gutierrez et al. | |
| 2015/0218770 | A1* | 8/2015 | Arslan | E02D 5/60 405/211 |
| 2018/0371877 | A1 | 12/2018 | Zaragoza Labes et al. | |
| 2020/0062348 | A1* | 2/2020 | Wong | E21B 41/08 |

FOREIGN PATENT DOCUMENTS

| | | |
|---|---|---|
| WO | WO 2013/053936 | 4/2013 |
| WO | WO 2020/201719 | 10/2020 |

* cited by examiner

SUBSEA FOUNDATIONS

This invention relates to subsea foundations for supporting or controlling the position of subsea or floating structures such as pipelines, risers and surface installations used in the offshore energy industry. Embodiments of the invention relate particularly to easing the installation of pipelines or other elongate subsea elements, such as mooring lines, and improving the resistance of subsea foundations to lateral loads.

In this specification, unless the context requires otherwise, the term 'foundation' is not limited just to underlying structures for supporting a downward weight load but also encompasses anchors or other anchorage structures for resisting horizontal or lateral or upward loads, such as tensile loads in mooring lines or in pipelines during pipelay initiation.

Subsea foundations are often used to stabilise a floating structure. For example, a surface installation such as an FPSO (floating production, storage and offloading vessel) may be moored to the seabed to remain in substantially the same location for many years of oil and gas production. Some taut-leg floating production units are known but they require reinforced anchorages to be installed, which generally requires injection of concrete or grout. More typically, an FPSO is held in place by a mooring system comprising catenary-curved mooring lines arranged in groups to define semi-taut legs. When viewed from above, the mooring lines of each group splay apart to define a spread pattern.

To resist the predominantly lateral loads applied by catenary moorings, a subsea foundation may comprise a drag anchor that is held in place by its weight and by friction or engagement with the seabed. More commonly, however, anchoring against lateral loads is provided by a pile, this being a vertical element embedded into the seabed.

Suction piles can withstand upward withdrawal loads better than hammered piles, such as those described in WO 2013/053936, or torpedo piles that are dropped to penetrate the seabed. However, as the lateral resistance of suction piles may not be as strong as that provided by hammered piles or torpedo piles, there is a risk that a suction pile could capsize where lateral loads are high. WO 02/062653 addresses this by connecting a mooring chain to a suction pile beneath the mudline to avoid capsizing the pile under tension in the mooring chain. However, in applications where resistance to upward pulling loads is less significant, suction piles are less favoured than hammered piles or torpedo piles for mooring FPSOs or other surface installations.

Where a foundation comprises a drag anchor or chain connected to a pile as in WO 02/062653, resistance to lateral movement is strongly directional, being biased to resist in-service tension in a line connected to the foundation. There is much less resistance to lateral movement in opposite or transverse directions, and to upward movement away from the seabed.

Another use for a subsea foundation is to anchor a pipeline or other elongate element to the seabed. For example, to facilitate pipelay initiation, a subsea foundation may be preinstalled in the seabed before an end of the pipeline is coupled to the foundation. This provides a fixed point for an installation vessel to act against at the start of the pipelaying process. The resulting reaction force keeps the catenary between the vessel and the seabed under tension and avoids longitudinal slippage of the pipeline under that tension.

A pipeline or other elongate element may also be anchored by a subsea foundation to restrain its movement relative to the seabed in service, for example movement driven by cycles of thermal expansion and contraction. In that case, a pipeline may be anchored not just at an end but also at an intermediate location along the length of the pipeline.

A subsea foundation may also be used with a riser that connects a pipeline on the seabed to a surface installation for transporting fluids between them. In that respect, foundations of the invention are primarily concerned with catenary- or wave-configuration risers that are anchored to minimise motion around the touch-down point (TDP) where the riser meets the seabed. For example, a steep-configuration riser is restrained at the TDP by a subsea base structure whereas a pliant-wave riser comprises a subsea anchor that controls motion around the TDP.

U.S. Pat. No. 7,360,968 takes the approach of combining a structure on a suction pile with a stopper on a pipeline. However, this does not allow for any lateral deviation or even for slight angular deviation from the foreseen path or trajectory of the pipeline.

In U.S. Pat. No. 7,600,569, a yoke on a pipeline connects to a foundation structure that is preinstalled on the seabed and then guides a connector hub on a riser into position. Again, this solution again does not allow for lateral or angular deviation.

Another challenge is how to connect a supported element or structure to the pile after the pile has been installed in the seabed. In this respect, a mechanical connector may be mounted to the top of a preinstalled pile but that additional subsea operation complicates installation. Alternatively, a mechanical connector may be integrated with a pile to be installed with the pile, but that makes the pile heavier, bulkier and more complex. For example, U.S. Pat. No. 9,140,384 describes attachment of a pipeline termination assembly to a subsea structure that has capture slots to receive a pivoting part of the termination assembly. As another example, U.S. Pat. No. 8,038,368 describes adding a structure to a pile foundation to receive trolleys and heads for initiation of pipeline laying. A lighter, simpler alternative to the top structure of the pile is required.

U.S. Pat. No. 7,794,177 discloses a stab and hinge-over pipeline end terminal assembly in which a socket receptacle on a pile receives an articulated pin or post of the pipeline end. That arrangement is simple and efficient in principle but is less effective in practice because it is challenging to insert the post into the receptacle on the pile. The top of the pile also requires reinforcement around the receptacle.

U.S. Pat. No. 8,425,154 shows a pile supporting a receptacle that includes a pair of vertical slots, into which pins of a frame that carries a new pipe section are lowered, to dock the frame with the receptacle. Once the pins are received in the slots, the initially vertical frame turns through a right angle to rest on a top surface of the pile. The new pipe section is then connected to an open end of an existing pipeline by a jumper. The precise positioning required to dock two pins simultaneously with respective slots is challenging in a marine environment, as water movement induces corresponding movement of the suspended frame relative to the fixed receptacle.

Against this background, the invention provides a subsea foundation that comprises: an upright pile; a support table on top of the pile; and a capture rod fixed to the pile and extending above a level of the support table. When the pile is installed at a seabed location, a lower end portion of the capture rod is embedded in the seabed.

The capture rod is preferably inclined away from a central longitudinal axis of the pile in an upward direction. Consequently, a lower end of the capture rod may be fixed to a side wall of the pile whereas the capture rod may be spaced from the pile at the level of the support table.

A strut cantilevered from the side wall of the pile may extend to the capture rod at a level above the lower end of the capture rod. Nevertheless, a free end portion of the capture rod suitably extends above the level of the support table.

The support table preferably widens in a direction away from the capture rod. More generally, the support table may be offset relative to the pile in a direction opposed to the capture rod. For example, a portion of the support table overhanging the pile may face away from the capture rod. In particular, a minor portion of the support table overhanging the pile may face toward the capture rod and a major portion of the support table overhanging the pile may face away from the capture rod. At least one stopper formation may project upwardly from an upper side of the support table, the or each stopper formation preferably being offset toward the capture rod.

The inventive concept extends to a foundation system comprising the foundation of the invention and a connecting structure that is arranged to be seated on the support table of the foundation.

A catch structure joined to the connecting structure may be cooperable with the capture rod of the foundation. In particular, the catch structure may be pivotable with respect to the capture rod, for example about a substantially horizontal axis. It is also possible for the catch structure to be pivotable around the capture rod about a vertical axis, and for the catch structure to be slidable along the capture rod. Optionally, the catch structure is also pivotable relative to the connecting structure, for example about a horizontal axis To allow for heave of an installation vessel, the catch structure preferably defines an elongate slot that is configured to accommodate the capture rod. For example, the slot may be defined by a loop formation of the catch structure. The slot and the capture rod may both lie in a common plane.

A levelling interface may be provided on an underside of the connecting structure to be sandwiched between the connecting structure and the support table.

The connecting structure may be joined to a line, that line being a pipeline, a mooring line or a riser, or a link to a pipeline, a mooring line or a riser. For example, the connecting structure may be a termination structure joined or linked to a pipeline, such as a PLET joined to an end of the pipeline. In other examples, the connecting structure may be an anchor structure that is joined or linked to a mooring line or a support structure that is joined or linked to a riser.

The inventive concept also embraces a corresponding method of connecting a line to a subsea foundation. The method comprises: suspending a connecting structure from the line; capturing the connecting structure on a capture rod that is fixed to a pile of the foundation and that extends above a level of a support table on top of the pile; and pivoting the connecting structure about the capture rod before landing the connecting structure on the support table.

The connecting structure may be pivoted about the capture rod around horizontal and/or vertical axes before being landed on the support table. The connecting structure may also be slid down the capture rod before being landed on the support table. Meanwhile, the connecting structure may be suspended between the capture rod and the line under tension in the line. It is also possible to pivot the connecting structure about the capture rod around a vertical axis after the connecting structure has been landed on the support table. Nevertheless, the connecting structure may be locked relative to the support table.

Conveniently, the capture rod may be engaged with a downwardly-projecting catch structure of the connecting structure, for example in a downwardly-elongate slot of the catch structure. The catch structure may be pivoted relative to the connecting structure, for example about a horizontal axis, before the connecting structure is landed on the support table.

After landing the connecting structure on the support table, movement of the connecting structure toward the capture rod may be restrained by engagement with at least one aforementioned stopper formation. Conversely, movement of the connecting structure away from the capture rod may be restrained by continued engagement with the capture rod after landing the connecting structure on the support table.

Embodiments of the invention provide an initiation and anchoring system that comprises an oblong and optionally articulated eye-link piece attached to or integrated into a termination structure such as a PLET (pipeline end termination). The eye link is hooked up for installation to an initiation/anchoring suction pile via a tilted pipe or rod that is fixed to the pile.

The foundation design of the invention provides excellent vertical tolerances while satisfying a requirement for the termination structure to be fully anchored with movement restricted along X, Y and Z axes. A stopper prevents movement of the termination structure in one direction, namely aft, while the oblong-eye link prevents movement of the termination structure in the opposite direction, namely forward. Traditional PLET anchoring concepts employing a mooring chain, connected to a typical pile, cannot enable such extensive restriction of movement of the termination structure.

The invention enables quicker installation than traditional initiation methods with minimal ROV operations. There is no need to handle chains and no need for pre-initiation works such as pre-abandonment of chains.

The foundation design of the invention also provides a robust solution against degradation of the seabed soil. In particular, stability of the foundation is not significantly affected by soil erosion, for example due to long-term exposure to currents at the seabed. A simplified termination structure design is possible with no need for mudmats. The termination structure is instead stabilised on a support table on top of the pile.

The invention has good tolerance to variations in the pipeline heading relative to the as-installed heading of a pile. In particular, by virtue of the eye-link, the termination structure is free to rotate around the tilted rod during initiation. This eases initiation in a congested area of the seabed, particularly when compared to traditional anchoring/initiation systems. A multi-angle locking system may be engaged to lock the termination structure to the foundation after installation has been completed.

In comparison with the prior art, the invention provides an optimised seating area for landing and stabilisation of a termination structure. As there is a minimal area for a support table on top of a pile, the termination structure hinges over aft of the pile to optimise the landing area.

The invention simplifies the design of a pile. For example, the top deck of a prior art suction pile like that of U.S. Pat. No. 7,794,177 has to be reinforced to accommodate a stab-pin receptacle, but such reinforcement is unnecessary in a pile of the invention. The invention also allows the size of the pile to be reduced because anchoring forces are diverted toward the centre of gravity of the pile via the tilted rod.

The invention also simplifies installation procedures. A horizontal approach naturally engages the elongate eye-link with the tilted rod, with good tolerance to heave motion. This is in contrast to prior art arrangements like that of U.S. Pat. No. 7,794,177, which requires great precision to insert a stab-pin into a receptacle of a suction pile.

The overall sequence of a pipelay campaign employing the invention may be exemplified as follows. Firstly, a suction pile carrying a support table is fully installed within a designed heading tolerance. Post-installation, after a suitable interval, the pile is surveyed, for example using an ROV. In particular, heading and levelling data is collected and post-processed. Next, optionally, a levelling table is fabricated in accordance with the survey results and is then assembled with a PLET to complete fabrication of the PLET.

The offshore pipelay campaign can now begin. No pre-installation works are required. An ROV need only perform a general video inspection.

The PLET is deployed and lowered in a free-hanging configuration, with horizontal approach and hook-up of the eye-link to the tilted rod. Vertical tolerance allows for hook-up even with vertical excursion due to heave motion of the installation vessel.

After pivoting about a horizontal axis at the interface between the eye-link and the rod, the PLET is laid down on top of the support table within a designed heading tolerance Pipelay is initiated and continues to stabilise initial layback of the pipeline before engaging a multiangle locking system to lock the PLET to the support table. A final inspection of the PLET and anchoring system is then performed.

Embodiments of the invention provide a foundation that comprises: a pile; a cantilever lateral extension to the pile; and a tilted connecting rod extending between a buried point of the pile and a distance above the mudline, via a point of the cantilever extension.

Embodiments of the invention also provide a foundation assembly comprising such a foundation and a connecting structure comprising a slot that is able to catch the connecting rod and to slide along the connecting rod. The connecting structure may then be docked on and secured to the pile.

Embodiments of the invention also implement a method for connecting a line—such as a mooring line, a pipeline initiation line, a pipeline, or a link connected to a pipeline—to such a foundation. The method comprises: catching an upper tip of the connecting rod by a connecting structure that comprises an interface for the line; sliding the connecting structure down along the rod; and connecting the connecting structure to the top of the pile. The line may be connected to the connecting structure before or after the steps above.

The connecting structure may, for example, be connected to a pipeline initiation line, a mooring line or a pipeline touch-down point. The connecting structure may be a PLET.

The cantilever extension may be a rigid structure. The connecting structure may comprise a solid or rigid frame or a flexible lasso-like loop.

In summary, a subsea foundation of the invention comprises an upright pile, a support table on top of the pile, and a capture rod fixed to the pile and extending above a level of the support table. A lower end of the capture rod may be fixed to a side wall of the pile and the capture rod may be inclined away from a central longitudinal axis of the pile in an upward direction.

A line such as a pipeline or a mooring line is then connected to the subsea foundation by suspending a connecting structure from the line, capturing the connecting structure on the capture rod and pivoting the connecting structure about the capture rod before landing the connecting structure on the support table. The connecting structure may be pivoted about the capture rod around horizontal and/or vertical axes and may be slid down the capture rod before landing on the support table.

In order that the invention may be more readily understood, reference will now be made, by way of example, to the accompanying drawings in which:

FIG. 1 is a schematic side view of a pile of the invention installed in the seabed;

FIG. 2 corresponds to FIG. 1 but shows a connecting structure of the invention in the form of a PLET, attached to the pile.

Figure 4:
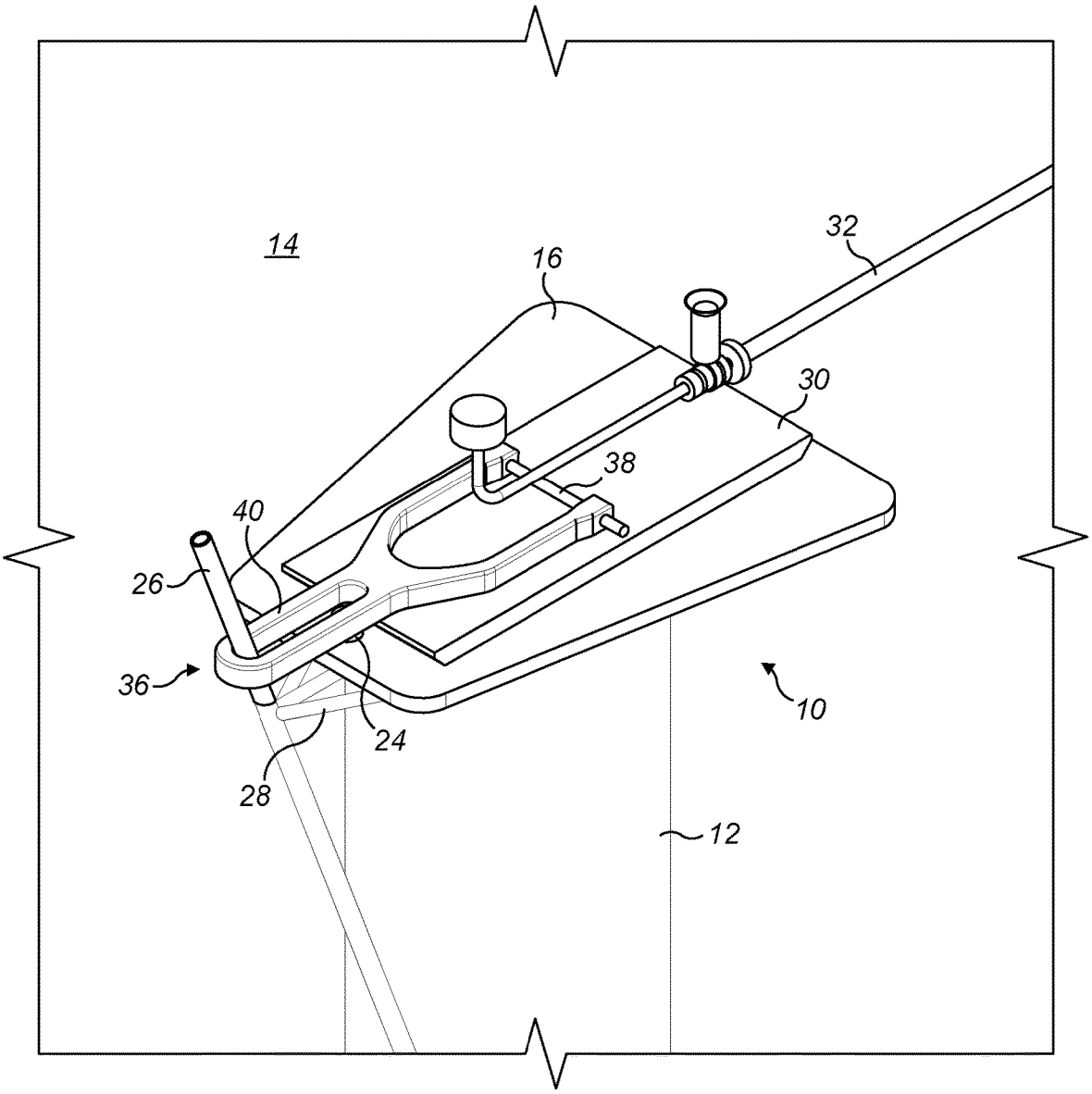
FIG. 4 is a perspective view of the pile and the PLET shown in FIG. 3.
Figure 5A:
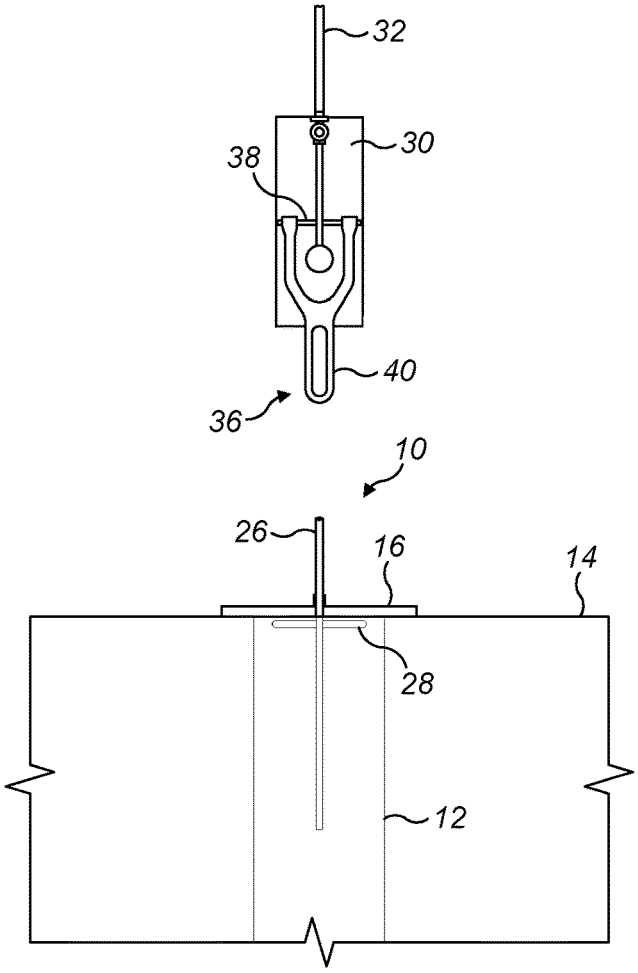
Figure 5B:
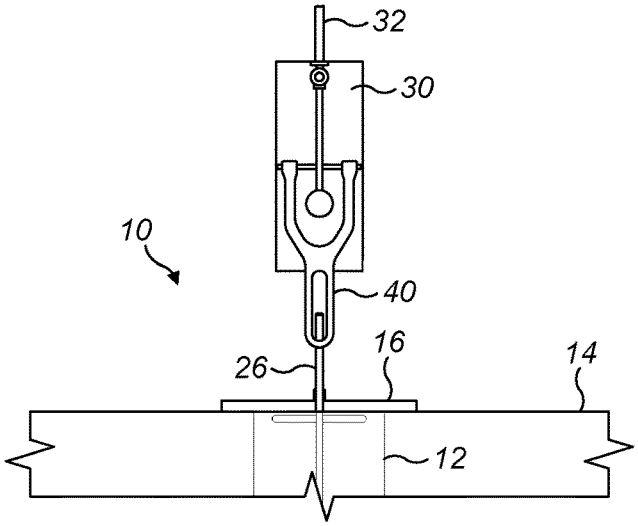
Figure 6C:
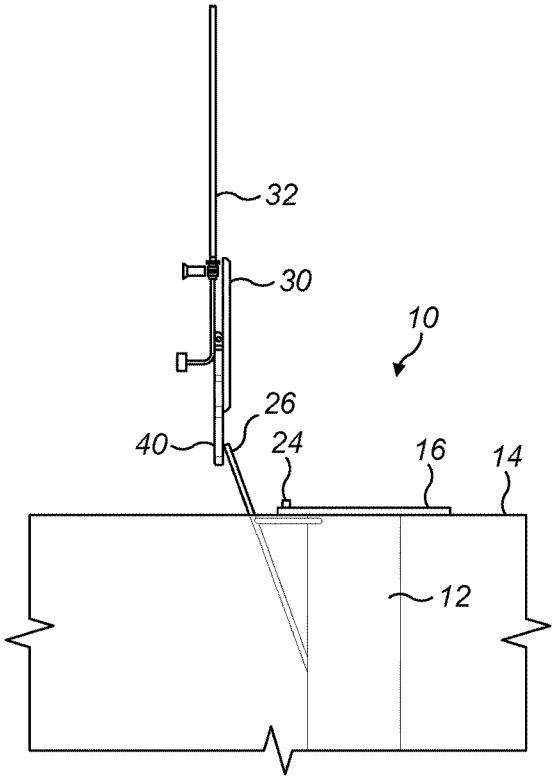
Figure 6B:
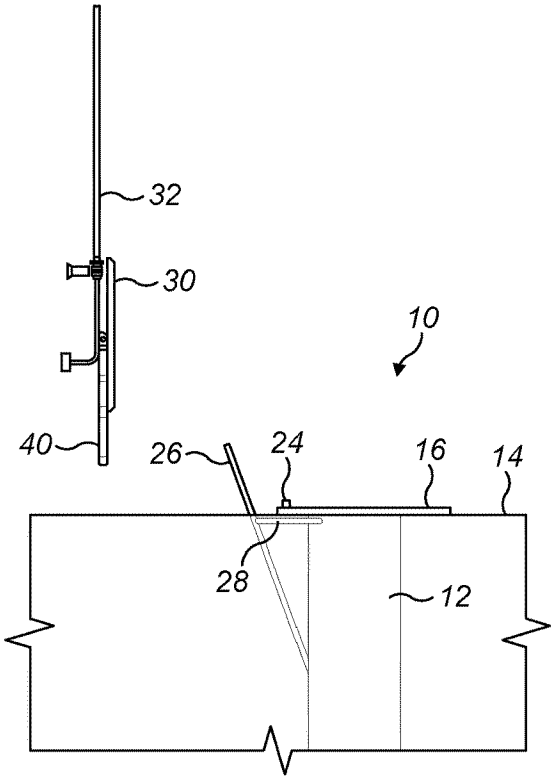
Figure 6A:
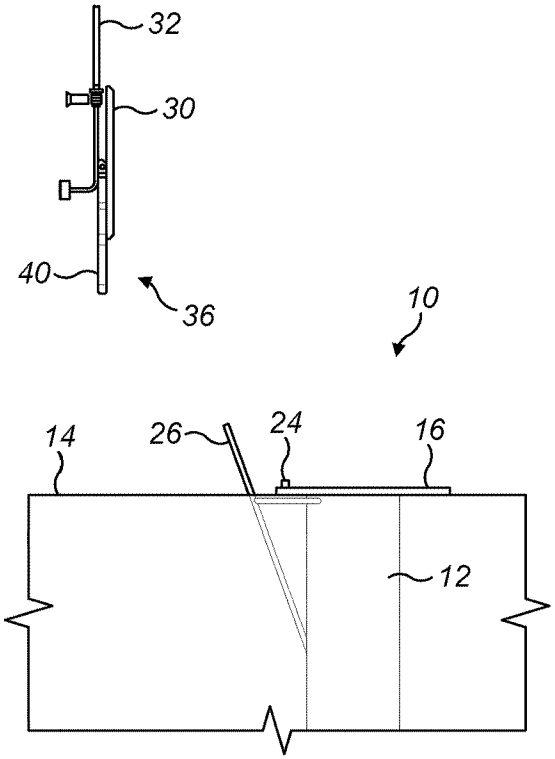
Figure 8:
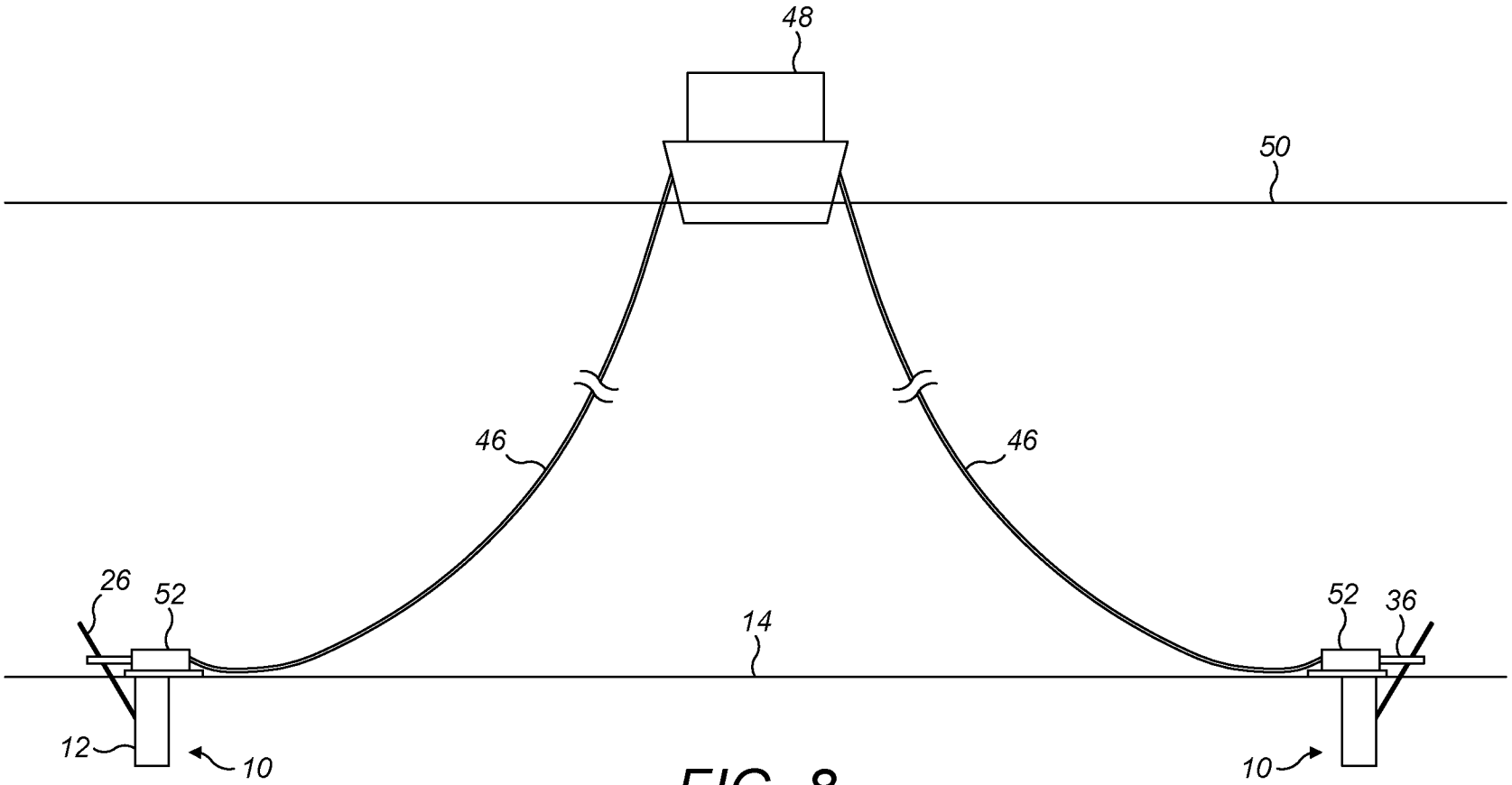
Figure 9:
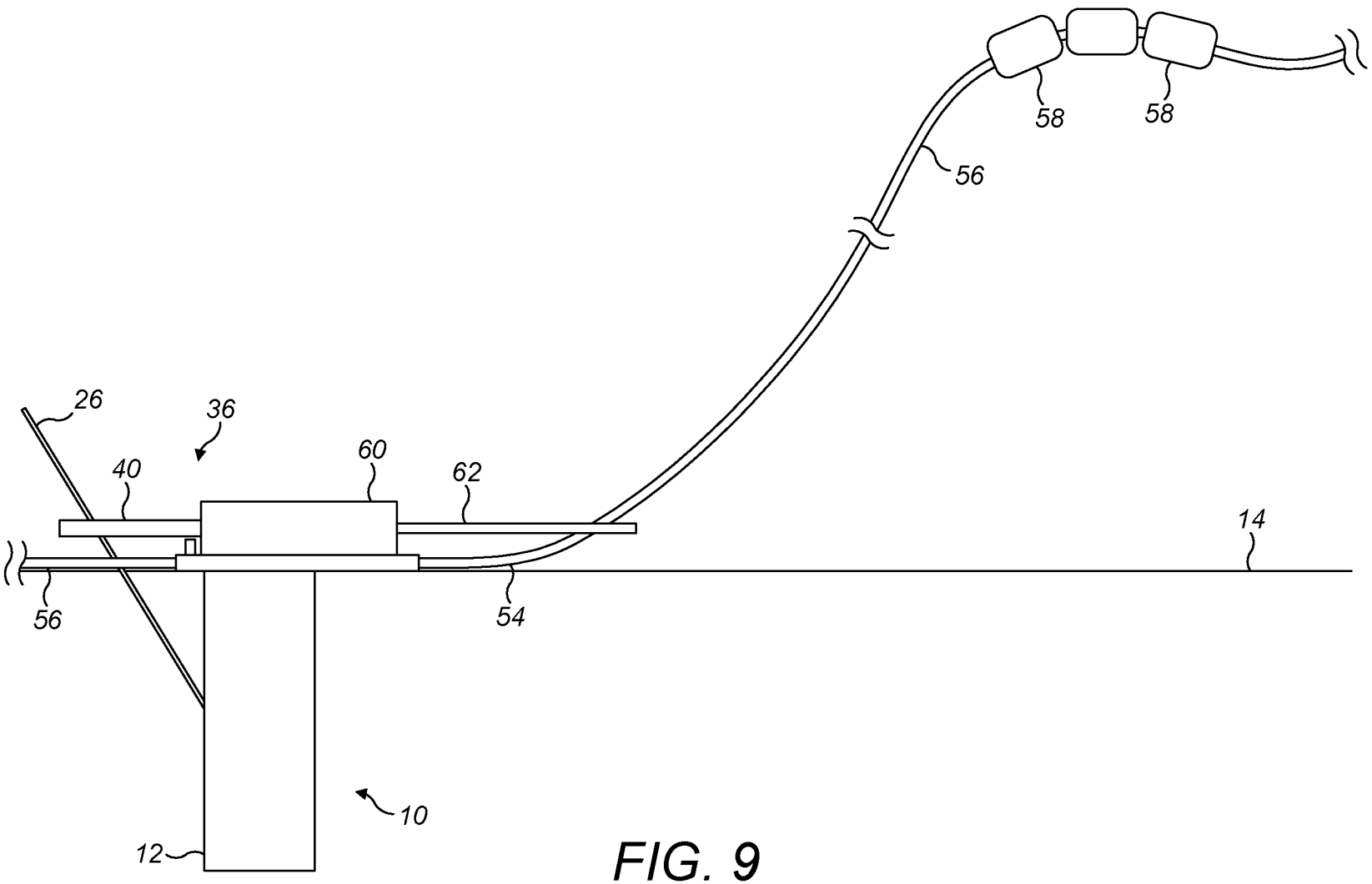
Figure 10A:
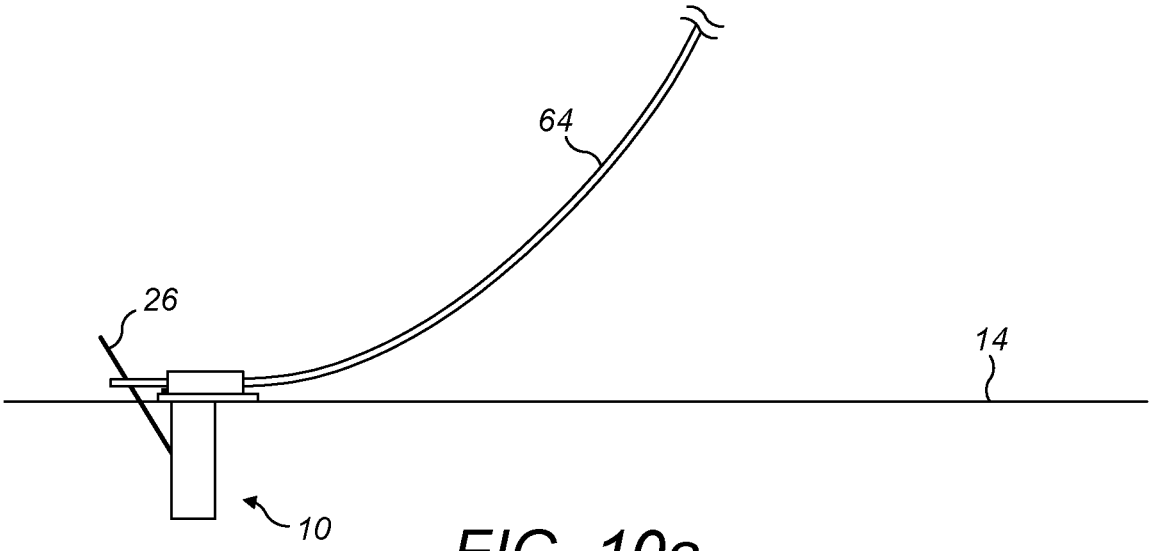
Figure 10B:
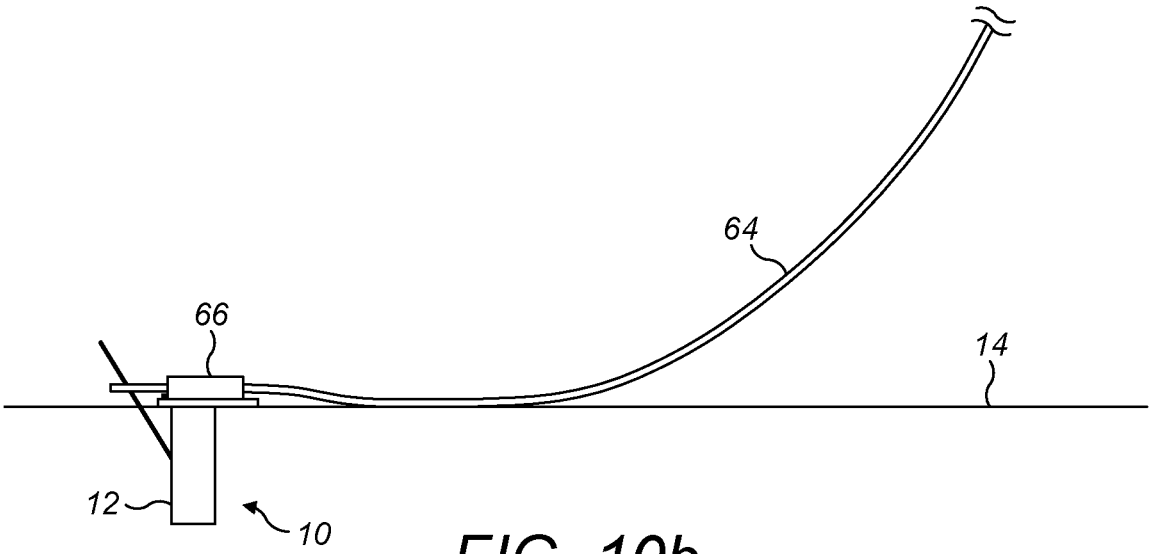
Figure 10C:
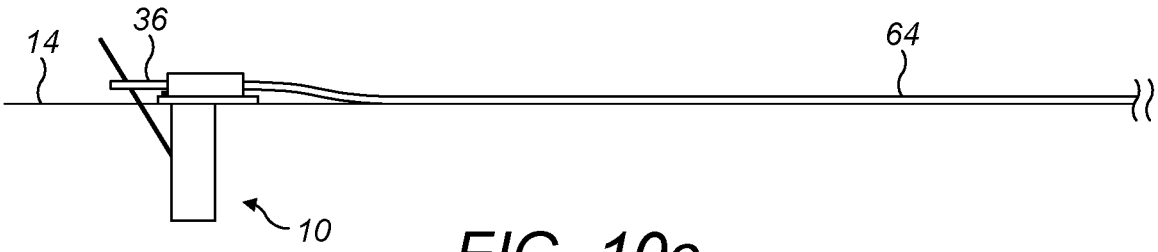

FIGS. 5*a* and 5*b* are a sequence of end views of the PLET of FIG. 4 being lowered toward engagement with an upwardly-protruding capture rod of the pile;

FIGS. 6*a* to 6*c* are a corresponding sequence of side views of the PLET being lowered toward and into engagement with the capture rod of the pile;

FIGS. 7*a* to 7*d* are a sequence of side views of the PLET pivoting around and sliding down the capture rod into engagement with the top of the pile;

FIG. 8 is a schematic side view showing piles of the invention in use when mooring an FPSO;

FIG. 9 is a schematic side view showing a pile of the invention in use when controlling the touch-down point of a riser; and FIGS. 10*a* to 10*c* are a sequence of schematic side views showing a pile of the invention in use when initiating a pipelaying operation.

Figure 1:
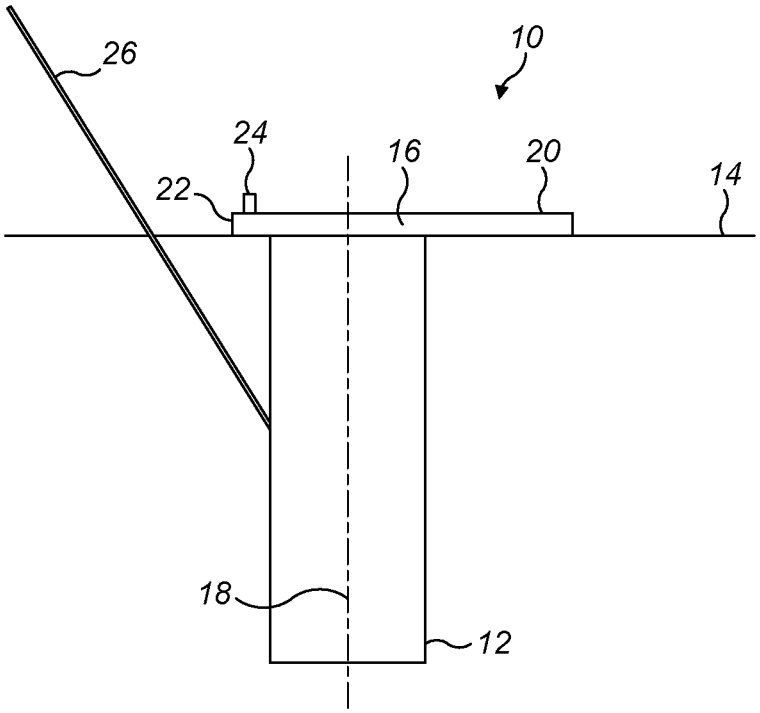
Figure 2:
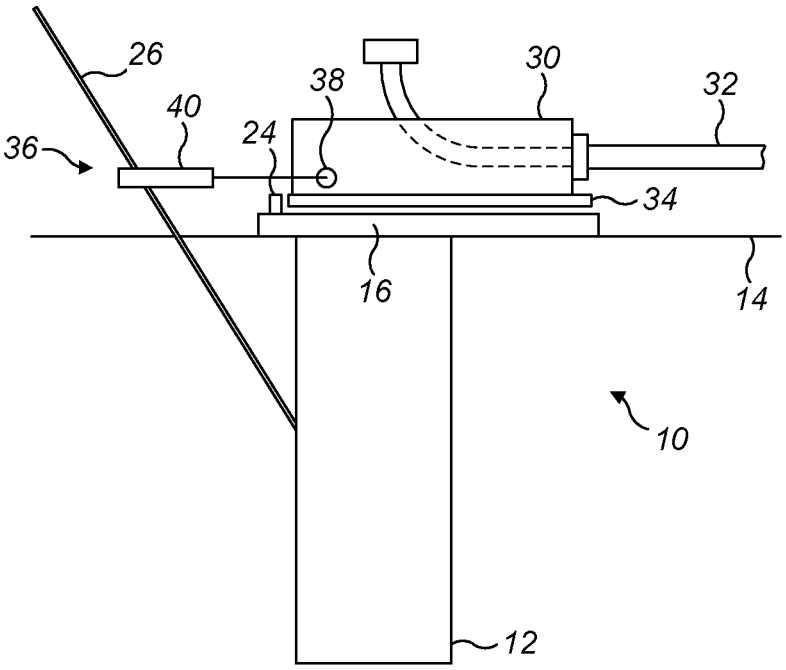

Referring firstly to FIGS. 1 to 4 of the drawings, a subsea foundation 10 of the invention comprises an upright cylindrical pile 12, in this example a tubular suction pile, shown embedded in the seabed 14 following installation. In FIGS. 1 and 2, a rearward or aft direction is to the left and a forward direction is to the right, coinciding with the direction in which a pipeline or other elongate element anchored by the foundation 10 is to be laid.

The pile 12 is surmounted by a support table 16 that defines a support surface lying in a substantially horizontal plane. The support table 16 is asymmetric about a central longitudinal axis 18 of the pile 12. Specifically, the support table 16 is offset forwardly such that a major overhanging portion 20 of the support table 16 extends forward from the pile 12. Conversely, no more than a minor overhanging portion 22 of the support table 16 extends aft from the pile 12.

At least one stopper formation 24 protrudes upwardly from the support table 16. The or each stopper formation 24 is offset rearwardly toward an aft end of the support table 16.

A connecting or capture rod 26 of the foundation 10 protrudes upwardly from the seabed 14 like a post, at a location rearward of an aft end of the support table 16. The rod 26 joins the pile 12 below the level of the seabed 14. In this example, the rod 26 is inclined relative to the vertical, extending upwardly and leaning rearwardly from an aft side of the pile 12. Thus, the rod 26 is inclined away from the central longitudinal axis 18 moving upwardly from its junction with the pile 12.

FIG. 4 shows that the rod 26 may be supported by a cantilevered strut 28 extending rearwardly from the aft side of the pile 12, above the junction between the rod 26 and the pile 12. The strut 28 is shown in FIG. 4 just beneath the seabed 14 but it could instead lie at or above the level of the seabed 14. The rod 26 extends above the strut 28 to a free end at the upper and rearward extremity of the rod 26.

Figure 3:
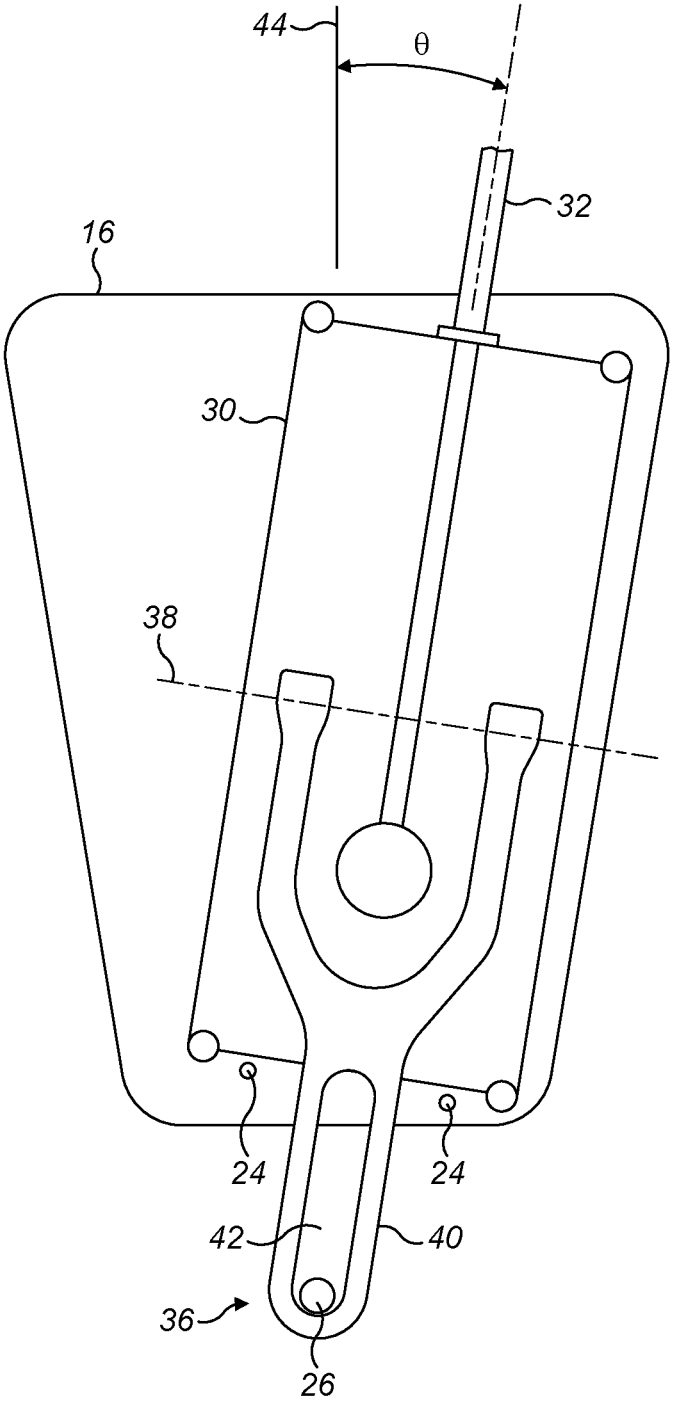
FIG. 3 is a top plan view of a pile of the invention with a PLET attached to it.

The plan view of FIG. 3 shows that the support table 16 splays or widens forwardly from the rod 26. In this example, the support table 16 has a shape approximating to an isosceles trapezium whose non-parallel sides converge rearwardly toward the rod 26.

FIGS. 2 to 4 show a connecting structure, exemplified here by a PLET 30 at an end of a rigid pipe 32, now engaged with the preinstalled foundation 10. The PLET 30 rests on the support table 16, where it is restrained against rearward movement relative to the pile 12 by the or each stopper formation 24 protruding upwardly from the support table 16. FIG. 3 shows two stopper formations 24 whereas FIG. 4 shows a variant with a single, central stopper formation 24. The or each stopper formation 24 may be positioned on the support table 16 before or after the PLET 30 is landed on the support table 16.

Optionally, as shown in FIG. 2, the PLET 30 has a levelling table or interface 34 on its underside to be interposed or sandwiched between the PLET 30 and the support table 16. The interface 34 compensates for any significant departure from the horizontal of the support surface of the support table 16, if a post-installation survey of the foundation 10 reveals such an anomaly. The interface 34 may, for example, be fabricated in response to metrology data obtained after installation and settling of the pile 12.

A catch structure 36 extends rearwardly from the PLET 30. The catch structure 36 could be rigidly attached to, or integral with, the PLET 30 but in this example the catch structure 36 is hinged to the PLET 30 about a pivot axis 38 that lies parallel to the base of the PLET 30 and so is horizontal. As seen in FIGS. 3 and 4, the catch structure 36 comprises an open frame or eye link that defines a loop 40 capable of capturing and accommodating the rod 26 in a slot 42. In this example, the loop 40 and hence the slot 42 defined by the loop 40 are elongate in the rearward direction. When the rod 26 is at the aft end of the slot 42, the PLET 30 is restrained against forward movement relative to the pile 12.

As best appreciated in FIG. 3, the rod 26 when engaged in the slot 42 of the loop 40 serves as a pivot defining a vertical axis about which the PLET 30 and the pipe 32 can be displaced angularly. In this respect, the PLET 30 and the pipe 32 are shown displaced by an angle θ with respect to a central longitudinal plane 44. The forwardly-widening support table 16 supports the PLET 30 throughout its range of angular movement.

When seated on the support table 16, the PLET 30 is restrained against rearward movement by the or each stopper formation 24, against forward and lateral movement by engagement of the rod 26 with slot 42 and against upward movement by the inclination of the rod 26, noting that any upward movement would also require rearward movement that is blocked. Thus, it will be apparent that the foundation 10 of the invention provides effective location of the PLET 30 along X, Y and Z axes while allowing pivotal yaw movement of the PLET 30 about the vertical or Z axis to accommodate variations in the heading of the PLET 30 and the pipe 32.

Turning next to FIGS. 5*a* to 6*c*, these drawings show the PLET 30 suspended from the pipe 32 as the PLET 30 and the pipe 32 hang vertically in the water column while approaching the foundation 10 pre-installed in the seabed 14. The front view of FIG. 5*a* corresponds to the side view of FIG. 6*a*, whereas the front view of FIG. 5*b* corresponds to the side views of FIGS. 6*b* and 6*c*. In each case, the loop 40 of the catch structure 36 hangs beneath the PLET 30, parallel to and in alignment with the pipe 32. The rod 26 leans rearwardly toward the PLET 30. The PLET 30 is moved downwardly and forwardly to bring the loop 40 into engagement with the tip of the rod 26.

Initially, as shown in FIGS. 5*a* and 6*a*, the loop 40 of the catch structure 36 is shown at a level above the rod 26 of the foundation 10. Next, the PLET 30 is lowered as shown in FIGS. 5*b* and 6*b* to bring the loop 40 to the level of the top or free end of the rod 26. Then, the PLET 30 is advanced forwardly toward the rod 26, parallel to the seabed 14, to engage the loop 40 around the tip of the rod 26 as shown in FIG. 6*c*.

Advantageously, the vertical elongation of the slot 42 defined by the hanging loop 40 of the catch structure 36 provides for heave excursion if the pipe 32 and hence the PLET 30 experience vertical movement due to heave motion of the vessel that supports them.

When the loop 40 of the catch structure 36 has been engaged with the tip of the rod 26, FIGS. 7*a* to 7*d* show how the PLET 30 pivots about a horizontal axis until the PLET 30 lies horizontally on the support table 16. The horizontal axis about which the PLET 30 pivots, which is defined between the rod 26 and the aft end of the loop 40, translates forwardly down the rod 26 as the loop 40 slides down the rod 26. During this motion, the PLET 30 is suspended between the rod 26 and the pipe 32 by tension applied through the pipe 32 as a vessel (not shown) supporting the pipe 32 continues to move forwardly relative to the foundation 10.

Figure 7A:
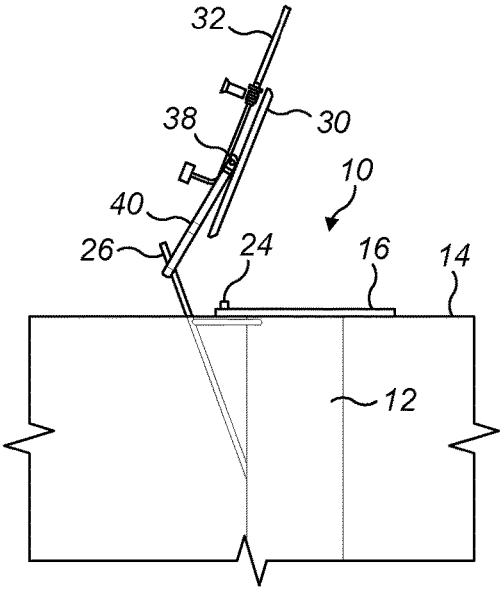
Figure 7B:
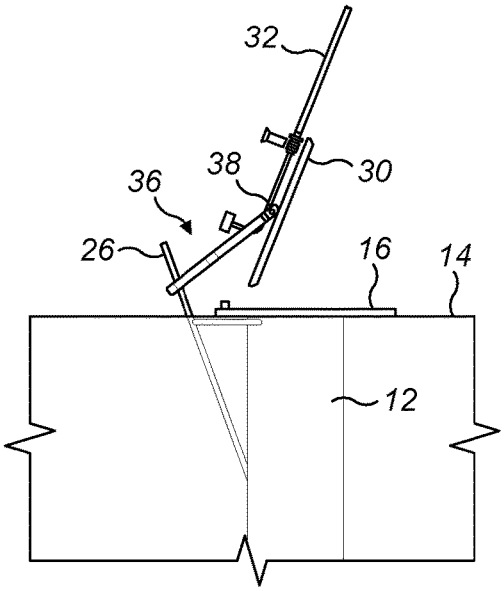

FIG. 7*a* shows the PLET 30 starting to tilt from the vertical as the loop 40 of the catch structure 36 starts to slide forwardly down the rod 36. In this example, the catch structure 36 pivots about the optional pivot axis 38 toward the horizontal to limit pivotal movement of the PLET 30, thereby controlling bending stress in the pipe 32. In this respect, in will be noted from FIG. 7*b* that as the operation continues, the catch structure 36 pivots further toward the horizontal without requiring corresponding pivoting of the PLET 30. In this way, the catch structure 36 decouples angular movement of the PLET 30 from engagement of the catch structure 36 with the rod 36.

Figure 7C:
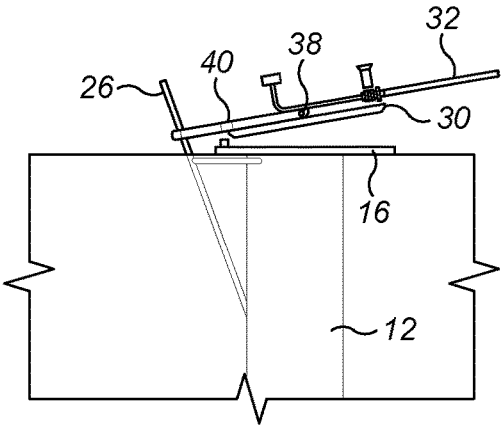

Eventually, as shown in FIG. 7*c*, the PLET 30 pivots relative to the catch structure 36 to a more horizontal orientation as the adjoining end of the pipe 32 begins to approach the horizontal. Thus, the pipe 32 and the PLET 30 come back toward alignment with the catch structure 36 as the loop 40 of the catch structure 36 continues to slide down the rod 26.

Figure 7D:
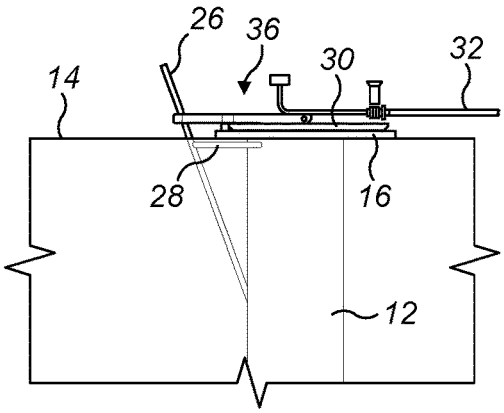

Finally, as the adjoining end of the pipe 32 reaches a horizontal orientation, the PLET 30 also reaches a horizontal orientation as it lands on the support table 16 of the foundation 10 as shown in FIG. 7*d*. On landing on the support table 16, a rearward end of the PLET 30 engages behind the or each stopper formation 24 to restrain the PLET 30 against rearward movement. Conversely, continued engagement of the rod 26 with the loop 40 of the catch structure 36 restrains the PLET 30 against forward movement.

Moving on now to FIG. 8, this shows that the invention can be used with lines other than pipelines and with terminations other than PLETs. In this example, foundations 10 of the invention serve as anchors for catenary mooring lines 46 that fix the position of an installation such as an FPSO 48 floating at the surface 50. Consequently, each mooring line 46 terminates at its bottom end in an anchor structure 52 that is coupled to the foundation 10 in the same manner as the PLET 30 shown in the preceding drawings. For this purpose, each anchor structure 52 has a catch structure 36 that engages the rod 26 of the foundation 10. The catch structure 36 may comprise a loop 40 like that shown in the preceding drawings and may be fixed or pivotable relative to the anchor structure 52.

In a foundation 10 of the invention, the rod 26 leans away from the direction of tension in a pipeline or other line that is anchored by the foundation 10. Thus, as tensile forces in the mooring lines 46 opposed about the FPSO 48 act in opposing directions, the rods 26 of the respective foundations 10 face in opposite outward directions with respect to the FPSO 48. The foundations 10 and the associated mooring lines 46 are mirrored about a vertical plane intersecting the FPSO 48.

FIG. 9 shows a foundation 10 of the invention being used to control the touch-down point 54 of a subsea riser 56. In this example, the riser 56 is of wave configuration, comprising a hogbend section supported by buoyancy modules 58. Here, a support structure 60 is landed on the foundation 10 in the manner of the PLET 30 and the anchor structure 52 of the preceding embodiments. The support structure 60 therefore has a similar catch structure 36 that engages the rod 26 of the foundation 10. The support structure 60 also has a rearward extension 62 that encircles and engages the riser 56 to prevent movement of the touch-down point 54 across the seabed 14 away from the foundation 10.

Turning finally to FIGS. 10*a* to 10*c*, these drawings show a foundation 10 of the invention being used to facilitate initiation of a pipeline 64 or other elongate element to be laid on the seabed. The pipeline 64 has a termination head 66 at one end that is landed on the foundation 10 in the manner of the PLET 30, the anchor structure 52 and the support structure 60 of the preceding embodiments. Again, therefore, the termination head 66 has a similar catch structure 36 that is arranged to engage the rod 26 of the foundation 10.

In FIG. 10*a*, the termination head 66 has just been landed on the foundation 10. The pipeline 64 is shown hanging as a catenary, initially held clear of the seabed 14 under tension applied by an installation vessel at the surface (not shown). The termination head 66 fixed to the foundation 10 reacts against hold-back tension applied to the pipeline 64 by the installation vessel.

In FIG. 10*b*, the installation vessel has begun to lay the pipeline 64 on the seabed 14. The remainder of the pipeline 64 hangs from the installation vessel as a catenary, held clear of the seabed 14 by tension. The termination head 66 fixed to the foundation 10 continues to react against hold-back tension in the pipeline 64, as friction between the laid portion of the pipeline 64 and the seabed 14 is not yet sufficient to do so. However, when a great enough length of the pipeline 64 has been laid on the seabed 14 to react against hold-back tension applied by the installation vessel, the remainder of the pipeline 64 can be laid normally as shown in FIG. 10*c*.

The pipeline 64 need not follow a straight path across the seabed 14: the path may be curved in plan view, for example to create expansion loops, to follow favourable contours of the seabed 14 or to avoid other structures on the seabed 14. In that case, the termination head 66 may continue to pivot about the capture rod 26 and slide on the support table 16 of the foundation 10 during installation of the pipeline 64. Eventually, the termination head 66 may be locked to the support table 16 on an appropriate heading or may be left free to pivot and slide relative to the support table 16 in response to movement of the pipeline 64 in service.

Many other variations are possible without departing from the inventive concept. For example, the pipeline 64 shown in FIGS. 10*a* to 10*c* could be connected to the termination head indirectly via initiation rigging. Also, the invention can be used with rigid or flexible pipelines or with other elongate line elements such as umbilicals, cables or pipes for service fluids.

The invention claimed is:

1. A subsea foundation, comprising:
an upright pile;
a support table on top of the pile; and
a capture rod fixed to the pile and extending above a level of the support table;
wherein when the pile is installed at a seabed location, a lower end portion of the capture rod is embedded in the seabed.

2. The foundation of claim 1, wherein the capture rod is inclined away from a central longitudinal axis of the pile in an upward direction.

3. The foundation of claim 1, wherein a lower end of the capture rod is fixed to a side wall of the pile.

4. The foundation of claim 1, wherein a strut cantilevered from the side wall of the pile extends to the capture rod above the lower end of the capture rod.

5. The foundation of claim 1, wherein a free end portion of the capture rod extends above the level of the support table.

6. The foundation of claim 1, wherein the capture rod is spaced from the pile at the level of the support table.

7. The foundation of claim 1, wherein the support table widens in a direction away from the capture rod.

8. The foundation of claim 1, wherein the support table is offset relative to the pile in a direction opposed to the capture rod.

9. The foundation of claim 8, wherein a portion of the support table overhanging the pile faces away from the capture rod.

10. The foundation of claim 9, wherein a minor portion of the support table overhanging the pile faces toward the capture rod and a major portion of the support table overhanging the pile faces away from the capture rod.

11. The foundation of claim 1, further comprising at least one stopper formation that projects upwardly from an upper side of the support table.

12. A foundation system comprising the foundation of claim 1 and a connecting structure arranged to be seated on the support table of the foundation.

13. The system of claim 12, further comprising a catch structure that is joined to the connecting structure and is cooperable with the capture rod of the foundation.

14. The system of claim 13, wherein the catch structure is pivotable with respect to the capture rod.

15. The system of claim 14, wherein the catch structure is pivotable about a horizontal axis with respect to the capture rod.

16. The system of claim 14, wherein the catch structure is pivotable around the capture rod about a vertical axis.

17. The system of claim 13, wherein the catch structure is slidable along the capture rod.

18. The system of claim 13, wherein the catch structure defines an elongate slot that is configured to accommodate the capture rod.

19. The system of claim 18, wherein the slot and the capture rod lie in a common plane.

20. The system of claim 19, wherein the slot is defined by a loop formation of the catch structure.

21. The system of claim 13, wherein the catch structure is pivotable relative to the connecting structure.

22. The system of claim 21, wherein the catch structure is pivotable relative to the connecting structure about a horizontal axis.

23. The system of claim 12, further comprising a levelling interface on an underside of the connecting structure, positioned to be sandwiched between the connecting structure and the support table.

24. The system of claim 12, wherein the connecting structure is joined to a line being a pipeline, a mooring line, a riser or a link to a pipeline, a mooring line or a riser.

25. The system of claim 24, wherein the connecting structure is a termination structure joined or linked to a pipeline.

26. The system of claim 25, wherein the connecting structure is a PLET joined to an end of the pipeline.

27. The system of claim 24, wherein the connecting structure is an anchor structure joined or linked to a mooring line.

28. The system of claim 24, wherein the connecting structure is a support structure joined or linked to a riser.

29. The system of claim 12, wherein when landed on the support table, the connecting structure is restrained by a stopper formation and by engagement of the catch structure with the capture rod.

30. A method of connecting a line to a subsea foundation, the method comprising:

suspending a connecting structure from the line;

capturing the connecting structure on a capture rod that is fixed to a pile of the foundation and that extends above a level of a support table on top of the pile; and pivoting the connecting structure about the capture rod before landing the connecting structure on the support table.

31. The method of claim 30, comprising pivoting the connecting structure about the capture rod around horizontal and/or vertical axes before landing the connecting structure on the support table.

32. The method of claim 30, comprising sliding the connecting structure down the capture rod before landing the connecting structure on the support table.

33. The method of claim 30, comprising suspending the connecting structure between the capture rod and the line under tension in the line before landing the connecting structure on the support table.

34. The method of claim 30, comprising pivoting the connecting structure about the capture rod around a vertical axis after landing the connecting structure on the support table.

35. The method of claim 34, followed by locking the connecting structure relative to the support table.

36. The method of claim 30, comprising engaging the capture rod with a downwardly-projecting catch structure of the connecting structure.

37. The method of claim 36, comprising pivoting the catch structure relative to the connecting structure before landing the connecting structure on the support table.

38. The method of claim 37, wherein the catch structure is pivoted relative to the connecting structure about a horizontal axis.

39. The method of claim 36, comprising engaging the capture rod in a downwardly-elongate slot of the catch structure.

40. The method of claim 30, comprising restraining movement of the connecting structure toward the capture rod by engagement with at least one stopper formation after landing the connecting structure on the support table.

41. The method of claim 30, comprising restraining movement of the connecting structure away from the capture rod by continued engagement with the capture rod after landing the connecting structure on the support table.

* * * * *